US009940878B2

(12) United States Patent
Liang

(10) Patent No.: US 9,940,878 B2
(45) Date of Patent: Apr. 10, 2018

(54) AMOLED REAL-TIME COMPENSATION SYSTEM

(71) Applicant: Shenzhen China Star Optoelectronics Technology Co., Ltd., Shenzhen (CN)

(72) Inventor: Pengfei Liang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 75 days.

(21) Appl. No.: 14/787,770

(22) PCT Filed: Oct. 12, 2015

(86) PCT No.: PCT/CN2015/091717

§ 371 (c)(1),
(2) Date: Oct. 29, 2015

(87) PCT Pub. No.: WO2017/041343

PCT Pub. Date: Mar. 16, 2017

(65) Prior Publication Data

US 2017/0162125 A1 Jun. 8, 2017

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0426* (2013.01);
(Continued)

(58) Field of Classification Search
CPC .. G09G 3/32; G09G 2320/048; G09G 3/3258; G09G 2300/0819;
(Continued)

(56) References Cited

U.S. PATENT DOCUMENTS

2010/0253659 A1* 10/2010 Sugimoto ..... G09G 3/3233 345/206
2015/0061981 A1* 3/2015 Lee ..... G09G 3/3291 345/77

* cited by examiner

*Primary Examiner* — Md Saiful A Siddiqui
(74) *Attorney, Agent, or Firm* — Leong C. Lei

(57) ABSTRACT

The present invention provides an AMOLED real-time compensation system, comprising a source drive and real-time detection compensation integration module (2), in which a first operational amplifier and a second operational amplifier are provided. The positive, negative input ends of the first operational amplifier (Y1) respectively receive the drive thin film transistor source target voltage and the drive thin film transistor source actual voltage, and the output end outputs the difference value (ΔV) of the drive thin film transistor source target voltage and the actual voltage to implement real-time detection to a threshold voltage deviation of the drive thin film transistor (T2). Then, the second operational amplifier (Y2) accumulates the voltage difference value (ΔV) of the drive thin film transistor source target voltage and the actual voltage outputted by the outputted end of the first operational amplifier (Y1) to the data signal (data) voltage to implement real-time compensation to the threshold voltage deviation of the drive thin film transistor (T2). The real-time measurement, real-time compensation to each pixel unit can be realized and all the gray scale data signals (data) can be effectively compensated.

6 Claims, 5 Drawing Sheets

(52) U.S. Cl.
CPC ..... *G09G 2300/0838* (2013.01); *G09G 2300/0842* (2013.01); *G09G 2310/027* (2013.01); *G09G 2310/0291* (2013.01)

(58) Field of Classification Search
CPC ..... G09G 2320/045; G09G 2320/0233; G09G 2300/08; G09G 2320/043; G09G 2320/0626
See application file for complete search history.

AMOLED REAL-TIME COMPENSATION SYSTEM

CROSS REFERENCE

This application claims the priority of Chinese Patent Application No. 201510572417.X, entitled "AMOLED REAL-TIME COMPENSATION SYSTEM", filed on Sep. 9, 2015, the disclosure of which is incorporated herein by reference in its entirety.

FIELD OF THE INVENTION

The present invention relates to a display technology field, and more particularly to an AMOLED real-time compensation system.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution. Because the both the thin film transistor driving the organic light emitting diode and the organic light emitting diode itself have the threshold voltage deviations. Thus, the AMOLED display device generally requires setting the compensation system for compensation.

FIG. 1 is a structure diagram of an AMOLED compensation system according to prior art, comprising a plurality of pixel units 10 aligned in array, a source drive circuit 20 electrically coupled to each pixel unit 10, a gate drive circuit 30 electrically coupled to each pixel unit 10, a detection start circuit 40 electrically coupled to each pixel unit 10, a current detector 50 electrically coupled to each pixel unit 10, a control circuit 60 electrically coupled to the source drive circuit 20, the gate drive circuit 30, the detection start circuit 40 and the current detector 50 and a storage circuit 70 electrically coupled to the control circuit 60. FIG. 2 is a circuit diagram of one pixel unit 10 in FIG. 1. The pixel unit 10 comprises a first TFT T10, a second TFT T20, a third TFT T30, a capacitor C10 and an organic light emitting diode D10. A gate of the first TFT T10 receives the gate drive signal WR provided by the gate drive circuit 30, and a source receives the data signal data provided by the source drive circuit 20; a gate of the second TFT T20 is electrically coupled to the drain of the first TFT T10, and a drain is coupled to the constant high voltage level Vdd, and a source is coupled to the node A10; a gate of the third TFT T30 receives the detection start signal RD provided by the detection start circuit 40, and a source is coupled to the node A10, and a drain is coupled to the current detector 50 through a line L; an anode of the organic light emitting diode D10 is coupled to the node A10, and a cathode is grounded; one end of the capacitor C10 is electrically coupled to the gate of the second TFT T20, and the other end is electrically coupled to the node A10.

Please refer to FIG. 1 and FIG. 2 at the same time. The working procedure of the AMOLED compensation system according to prior art comprises a TFT detection stage, an organic light emitting diode detection stage and a display stage. The TFT detection stage is: the gate drive signal WR is raised with the gate drive circuit 30 to connect the first TFT T10, and the source drive circuit 20 outputs the data signal data of high voltage level to the second TFT T20, and the second TFT T20 is connected; the detection start circuit 40 boosts the detection start signal RD, and the third TFT T30 is connected, and the current flows into the current detector 50 through the line L; the current detector 50 transmits the measured current to the control circuit 60; the control circuit 60 calculates the threshold voltage deviation value of the second TFT T20 and stores in the storage circuit 70. The organic light emitting diode detection stage is: the gate drive signal WR is raised with the gate drive circuit 30 to connect the first TFT T10, and the source drive circuit 20 outputs the data signal data of low voltage level to the second TFT T20, and the second TFT T20 is disconnected; the detection start circuit 40 boosts the detection start signal RD, and the third TFT T30 is connected, and the current detector 50 discharges the organic light emitting diode D10 through the line L; the current detector 50 transmits the measured current of this moment to the control circuit 60; the control circuit 60 calculates the threshold voltage deviation value of the organic light emitting diode D10 and stores in the storage circuit 70. In the display stage, the data signal data is inputted in the control circuit 60. The control circuit 60 compensates the data signal data according to the threshold voltage deviation value of the TFT T20 and the threshold voltage deviation value of the organic light emitting diode D10 stored in the storage circuit 70, and then to display on the AMOLED panel.

The aforesaid AMOLED compensation system, of which the compensated data signal data is outputted through the source drive circuit 20 cannot effectively compensate the 0 and 255 gray scale data signals, and cannot implement real-time measurement, real-time compensation to each pixel unit.

SUMMARY OF THE INVENTION

An objective of the present invention is to provide an AMOLED real-time compensation system, which can effectively compensate all the gray scale data signals, and can implement real-time measurement, real-time compensation to each pixel unit.

For realizing the aforesaid objective, the present invention provides an AMOLED real-time compensation system, comprising: a plurality of pixel units aligned in array, a source drive and real-time detection compensation integration circuit electrically coupled to the pixel units of each column through data lines and detection lines, a gate drive circuit electrically coupled to the pixel units of each row, a detection start circuit electrically coupled to the pixel units of each column and a control circuit electrically coupled to the source drive and real-time detection compensation integration module, the gate drive circuit and the detection start module;

the pixel unit comprises a switch thin film transistor, a drive thin film transistor, a detection thin film transistor and an organic light emitting diode;

the gate drive circuit is employed to provide a gate drive signal to the pixel units of each row;

the detection start circuit is employed to provide a detection start signal to the pixel units of each column;

the source drive and real-time detection compensation integration circuit comprises a latch and buffer circuit, a drive thin film transistor source target voltage acquiring unit, a first operational amplifier and a second operational amplifier; the latch and buffer circuit is employed to receive, latch, buffer and output a data signal; the drive thin film transistor source target voltage acquiring circuit is electrically coupled to the latch and buffer circuit, and employed to calculate and acquire a drive thin film transistor source target voltage according to a functional relation f(data) of the drive thin film transistor source target voltage and the data signal; the first operational amplifier is electrically coupled to the drive thin film transistor source target voltage acquiring circuit and the pixel unit, and positive, negative input ends thereof respectively receive the drive thin film transistor source target voltage and a drive thin film transistor source actual voltage, and an output end outputs a difference value of the drive thin film transistor source target voltage and the actual voltage to implement real-time detection to a threshold voltage deviation of the drive thin film transistor; the second operational amplifier is electrically coupled to the latch and buffer circuit and the pixel unit, and a positive input end thereof receives the data signal, and a negative input end is grounded through a first switch and then coupled to the output end of the first operational amplifier, and an output end first outputs a data signal voltage, and then outputs a sum of the data signal voltage and an output end voltage of the first operational amplifier to implement real-time compensation to the threshold voltage deviation of the drive thin film transistor.

A gate of the switch thin film transistor receives a gate drive signal, and a source is electrically coupled to the output end of the second operational amplifier through the data line; a gate of the drive thin film transistor is electrically coupled to a drain of the switch thin film transistor, and a drain is coupled to a constant high voltage level, and a source is coupled to a node; a gate of the detection thin film transistor receives a detection start signal, and a source is coupled to the node, and a drain is electrically coupled to the negative input end of the first operational amplifier through the detection line; an anode of the organic light emitting diode is electrically coupled to the node, and a cathode is grounded.

The pixel unit further comprises a storage capacitor, and one end of the storage capacitor is electrically coupled to the gate of the drive thin film transistor, and the other end is electrically coupled to the node.

The source drive and real-time detection compensation integration circuit further comprises a current detector electrically coupled to the control module, and the current detector is connected or disconnected with the detection line through a second switch.

The AMOLED real-time compensation system further comprises a storage circuit electrically coupled to the control module, and the control circuit calculates the threshold voltage deviation of the organic light emitting diode according to a current value detected by the current detector, and the storage circuit is employed to store the threshold voltage deviation of the organic light emitting diode.

A work procedure of the AMOLED real-time compensation system comprises five stages in orders:

a data signal input stage: the control circuit controls the data signal to be inputted into the source drive and real-time detection compensation integration circuit to be latched in the latch and buffer circuit;

a data signal output stage: the gate drive signal is high voltage level, and the data signal is high voltage level, and the detection start signal is low voltage level, and the first switch is grounded, and the output end of the second operational amplifier outputs the data signal, and the switch thin film transistor is connected, and the drive thin film transistor is connected; the drive thin film transistor source target voltage acquiring circuit calculates and acquires a drive thin film transistor source target voltage according to the functional relation f(data) of the drive thin film transistor source target voltage and the data signal;

a drive thin film transistor threshold voltage deviation real-time detection stage: the detection start signal is high voltage level, and the detection thin film transistor is connected, and the positive, negative input ends of the first operational amplifier respectively receive the drive thin film transistor source target voltage and the drive thin film transistor source actual voltage, and the output end outputs the difference value of the drive thin film transistor source target voltage and the actual voltage;

a drive thin film transistor threshold voltage deviation real-time compensation stage: the first switch is coupled to the output end of the first operational amplifier, and the positive input end of the second operational amplifier receives the data signal, and the negative input end is coupled to the output end of the first operational amplifier, and the output end outputs the sum of the data signal voltage and the output end voltage of the first operational amplifier;

a display stage: the gate drive signal and the detection start signal are changed to be low voltage level, and the switch thin film transistor and the detection thin film transistor are disconnected, and the organic light emitting diode emits light for display.

The work procedure of the AMOLED real-time compensation system further comprises an organic light emitting diode threshold voltage deviation detection stage before the data signal input stage: the gate drive signal is high voltage level, and the data signal is low voltage level, and the detection start signal is high voltage level, and the first switch is grounded, and the second switch is closed, and the drive thin film transistor is disconnected, and the detection thin film transistor is connected, and the current detector is connected with the detection line through the second switch, and the current detector discharges the organic light emitting diode through the detection line, and the current detector transmits a measured current value to the control module, and the control circuit calculates an organic light emitting diode threshold voltage deviation, and stores in the storage devices;

in the next data signal input stage: the control circuit first compensates the data signal with the organic light emitting diode threshold voltage deviation, and then, inputs the compensated data signal into the source drive and real-time detection compensation integration module.

The first switch is grounded under control of low voltage level, and coupled to the output end of the first operational amplifier under control of high voltage level.

The present invention further provides an AMOLED real-time compensation system, comprising: a plurality of pixel units aligned in array, a source drive and real-time detection compensation integration circuit electrically coupled to the pixel units of each column through data lines and detection lines, a gate drive circuit electrically coupled to the pixel units of each row, a detection start circuit electrically coupled to the pixel units of each column and a control circuit electrically coupled to the source drive and real-time detection compensation integration module, the gate drive circuit and the detection start module;

the pixel unit comprises a switch thin film transistor, a drive thin film transistor, a detection thin film transistor and an organic light emitting diode;

the gate drive circuit is employed to provide a gate drive signal to the pixel units of each row;

the detection start circuit is employed to provide a detection start signal to the pixel units of each column;

the source drive and real-time detection compensation integration circuit comprises a latch and buffer circuit, a drive thin film transistor source target voltage acquiring unit, a first operational amplifier and a second operational amplifier; the latch and buffer circuit is employed to receive, latch, buffer and output a data signal; the drive thin film transistor source target voltage acquiring circuit is electrically coupled to the latch and buffer circuit, and employed to calculate and acquire a drive thin film transistor source target voltage according to a functional relation f(data) of the drive thin film transistor source target voltage and the data signal; the first operational amplifier is electrically coupled to the drive thin film transistor source target voltage acquiring circuit and the pixel unit, and positive, negative input ends thereof respectively receive the drive thin film transistor source target voltage and a drive thin film transistor source actual voltage, and an output end outputs a difference value of the drive thin film transistor source target voltage and the actual voltage to implement real-time detection to a threshold voltage deviation of the drive thin film transistor; the second operational amplifier is electrically coupled to the latch and buffer circuit and the pixel unit, and a positive input end thereof receives the data signal, and a negative input end is grounded through a first switch and then coupled to the output end of the first operational amplifier, and an output end first outputs a data signal voltage, and then outputs a sum of the data signal voltage and an output end voltage of the first operational amplifier to implement real-time compensation to the threshold voltage deviation of the drive thin film transistor;

wherein a gate of the switch thin film transistor receives a gate drive signal, and a source is electrically coupled to the output end of the second operational amplifier through the data line; a gate of the drive thin film transistor is electrically coupled to a drain of the switch thin film transistor, and a drain is coupled to a constant high voltage level, and a source is coupled to a node; a gate of the detection thin film transistor receives a detection start signal, and a source is coupled to the node, and a drain is electrically coupled to the negative input end of the first operational amplifier through the detection line; an anode of the organic light emitting diode is electrically coupled to the node, and a cathode is grounded;

wherein the pixel unit further comprises a storage capacitor, and one end of the storage capacitor is electrically coupled to the gate of the drive thin film transistor, and the other end is electrically coupled to the node;

wherein the source drive and real-time detection compensation integration circuit further comprises a current detector electrically coupled to the control module, and the current detector is connected or disconnected with the detection line through a second switch;

the AMOLED real-time compensation system further comprises a storage circuit electrically coupled to the control module, and the control circuit calculates the threshold voltage deviation of the organic light emitting diode according to a current value detected by the current detector, and the storage circuit is employed to store the threshold voltage deviation of the organic light emitting diode;

wherein a work procedure of the AMOLED real-time compensation system comprises five stages in orders:

a data signal input stage: the control circuit controls the data signal to be inputted into the source drive and real-time detection compensation integration circuit to be latched in the latch and buffer circuit;

a data signal output stage: the gate drive signal is high voltage level, and the data signal is high voltage level, and the detection start signal is low voltage level, and the first switch is grounded, and the output end of the second operational amplifier outputs the data signal, and the switch thin film transistor is connected, and the drive thin film transistor is connected; the drive thin film transistor source target voltage acquiring circuit calculates and acquires a drive thin film transistor source target voltage according to the functional relation f(data) of the drive thin film transistor source target voltage and the data signal;

a drive thin film transistor threshold voltage deviation real-time detection stage: the detection start signal is high voltage level, and the detection thin film transistor is connected, and the positive, negative input ends of the first operational amplifier respectively receive the drive thin film transistor source target voltage and the drive thin film transistor source actual voltage, and the output end outputs the difference value of the drive thin film transistor source target voltage and the actual voltage;

a drive thin film transistor threshold voltage deviation real-time compensation stage: the first switch is coupled to the output end of the first operational amplifier, and the positive input end of the second operational amplifier receives the data signal, and the negative input end is coupled to the output end of the first operational amplifier, and the output end outputs the sum of the data signal voltage and the output end voltage of the first operational amplifier;

a display stage: the gate drive signal and the detection start signal are changed to be low voltage level, and the switch thin film transistor and the detection thin film transistor are disconnected, and the organic light emitting diode emits light for display.

The benefits of the present invention are: the AMOLED real-time compensation system provided by the present invention comprises a source drive and real-time detection compensation integration module, in which a first operational amplifier and a second operational amplifier are provided. The positive, negative input ends of the first operational amplifier respectively receive the drive thin film transistor source target voltage and the drive thin film transistor source actual voltage, and the output end outputs the difference value of the drive thin film transistor source target voltage and the actual voltage to implement real-time detection to a threshold voltage deviation of the drive thin film transistor. Then, the second operational amplifier accumulates the voltage difference value of the drive thin film transistor source target voltage and the actual voltage outputted by the outputted end of the first operational amplifier to the data signal voltage to implement real-time compensation to the threshold voltage deviation of the drive thin film transistor. The real-time measurement, real-time compensation to each pixel unit can be realized and all the gray scale data signals can be effectively compensated.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
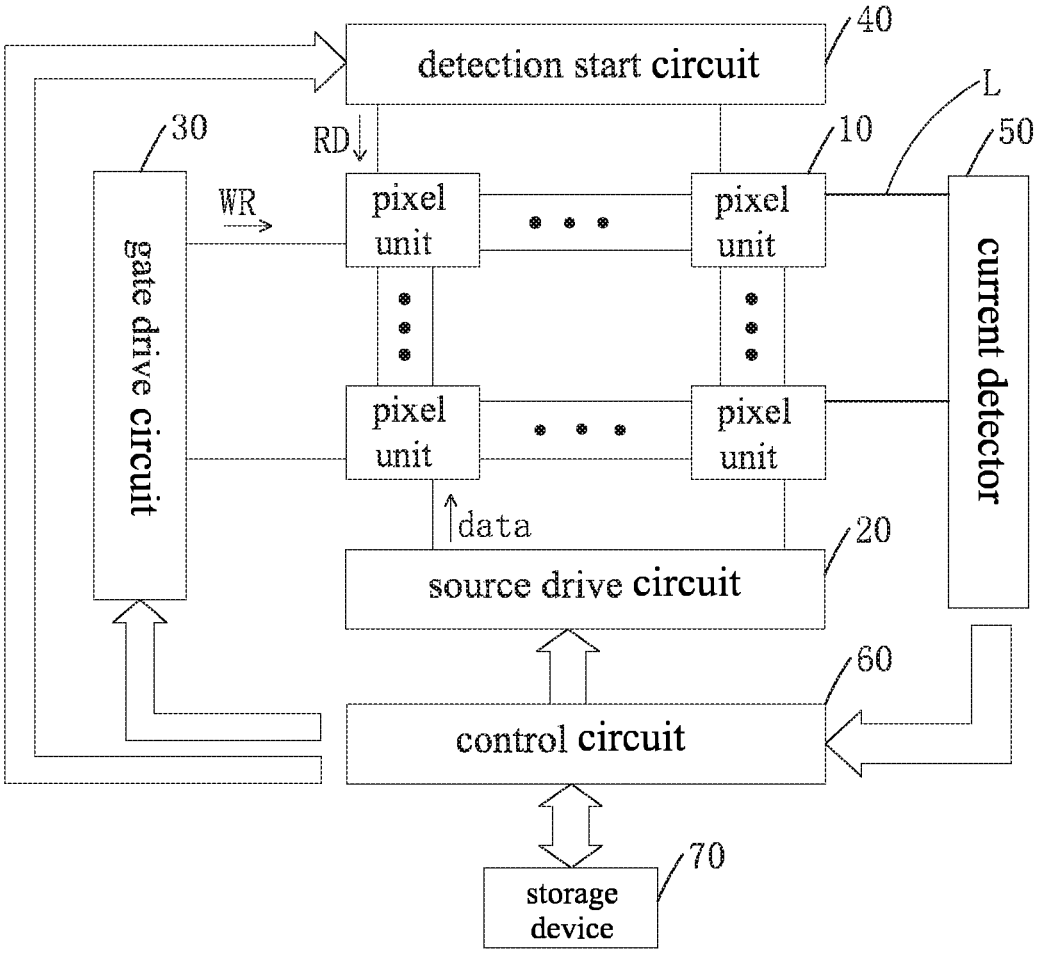
Fig. 1 (Prior Art)
FIG. 1 is a structure diagram of an AMOLED compensation system according to prior art.
Figure 2:
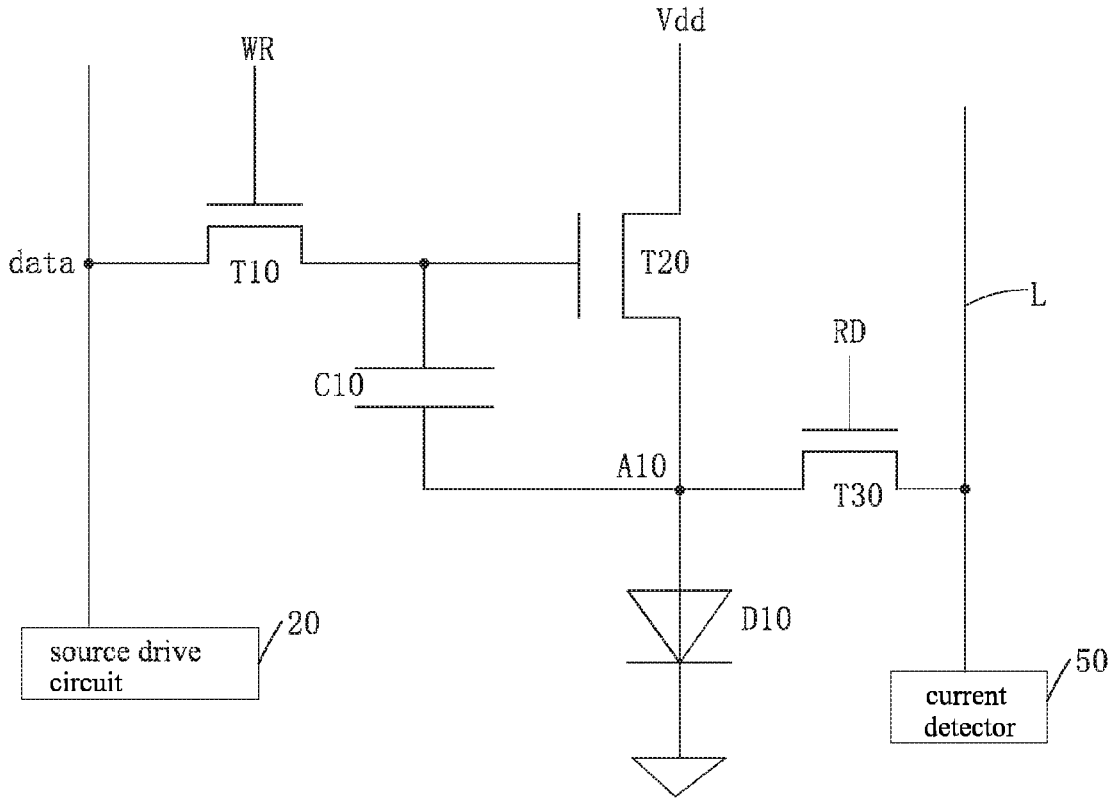
Fig. 2 (Prior Art)
FIG. 2 is a circuit diagram of one pixel unit in FIG. 1.
Figure 3:
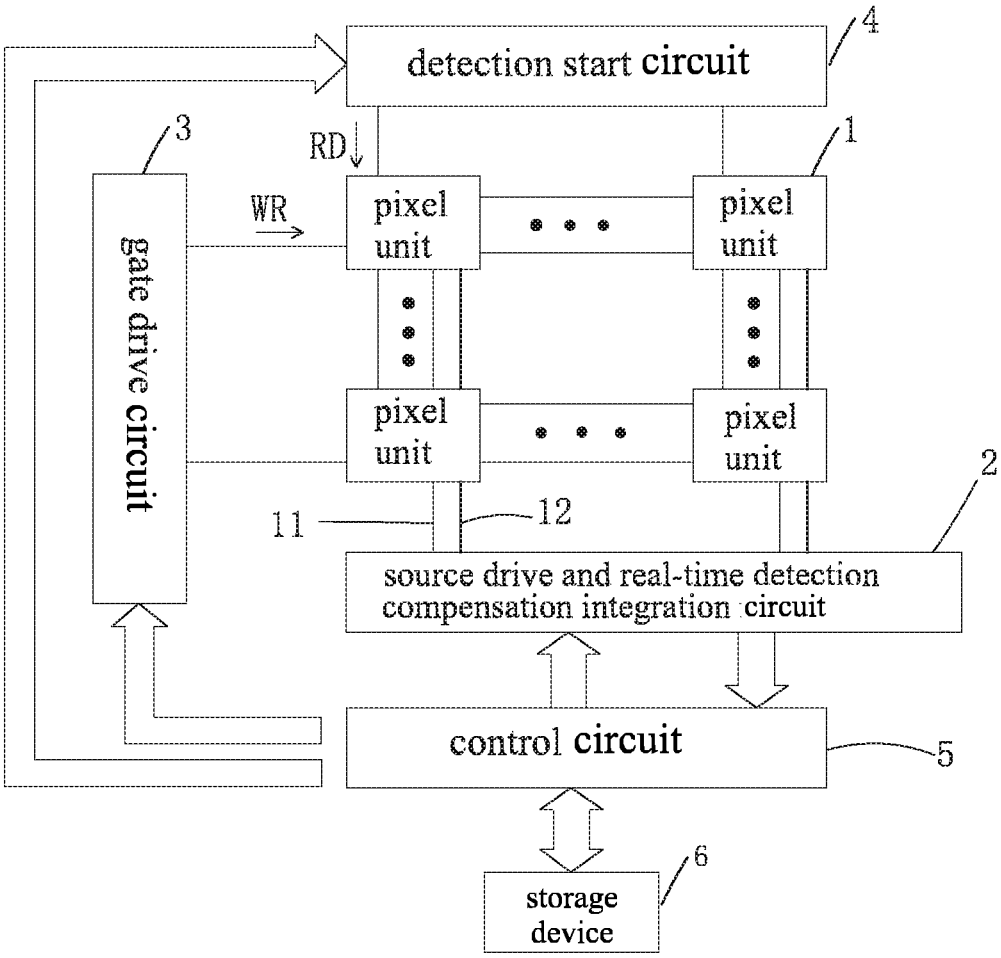
FIG. 3 is a structure diagram of an AMOLED real-time compensation system according to the present invention.
Figure 4:
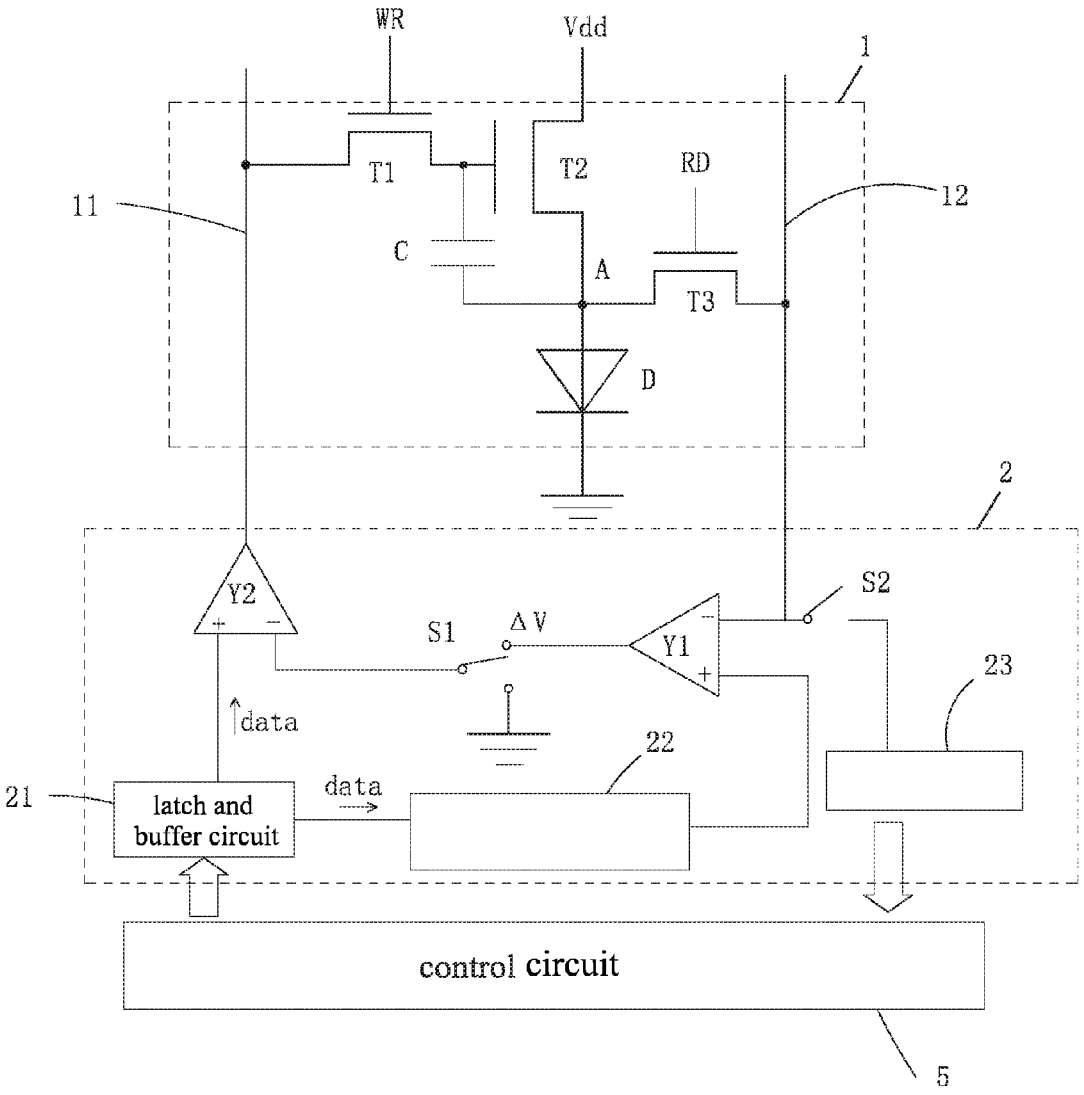
FIG. 4 is a circuit diagram of a source drive and real-time detection compensation integration circuit and a pixel unit in FIG. 3.

Please refer to FIG. 3 and FIG. 4. The present invention provides an AMOLED real-time compensation system, comprising: a plurality of pixel units 1 aligned in array, a source drive and real-time detection compensation integration circuit 2 electrically coupled to the pixel units 1 of each column through data lines 11 and detection lines 12, a gate drive circuit 3 electrically coupled to the pixel units 1 of each row, a detection start circuit 4 electrically coupled to the pixel units 1 of each column and a control circuit 5 electrically coupled to the source drive and real-time detection compensation integration circuit 2, the gate drive circuit 3 and the detection start circuit 4.

Specifically, the gate drive circuit 3 is employed to provide a gate drive signal WR to the pixel units 1 of each row.

The detection start circuit 4 is employed to provide a detection start signal RD to the pixel units 1 of each column.

The pixel unit 1 comprises a switch thin film transistor T1, a drive thin film transistor T2, a detection thin film transistor T3, an organic light emitting diode D and a storage capacitor C. A gate of the switch thin film transistor T1 receives a gate drive signal WR, and a source is electrically coupled to the output end of the second operational amplifier Y2 through the data line 11; a gate of the drive thin film transistor T2 is electrically coupled to a drain of the switch thin film transistor T1, and a drain is coupled to a constant high voltage level Vdd, and a source is coupled to a node A; a gate of the detection thin film transistor T3 receives a detection start signal RD, and a source is coupled to the node A, and a drain is electrically coupled to the negative input end of the first operational amplifier Y1 through the detection line 12; an anode of the organic light emitting diode D is electrically coupled to the node, and a cathode is grounded; one end of the storage capacitor C is electrically coupled to the gate of the drive thin film transistor T2, and the other end is electrically coupled to the node A.

Significantly, the source drive and real-time detection compensation integration circuit 2 comprises a latch and buffer circuit 21, a drive thin film transistor source target voltage acquiring circuit 22, a first operational amplifier Y1 and a second operational amplifier Y2.

The latch and buffer circuit 21 is employed to receive, latch, buffer and output a data signal data.

The drive thin film transistor source target voltage acquiring circuit 22 is electrically coupled to the latch and buffer circuit 21, and employed to calculate and acquire a drive thin film transistor source target voltage according to a functional relation f(data) of the drive thin film transistor source target voltage and the data signal, i.e. the target voltage of the node A, and f(data) can be chosen in the corresponding known functions by the persons who are skilled in the art.

The first operational amplifier Y1 is electrically coupled to the drive thin film transistor source target voltage acquiring circuit 22 and the pixel unit 21, and positive, negative input ends thereof respectively receive the drive thin film transistor source target voltage and a drive thin film transistor source actual voltage, and an output end outputs a difference value ΔV of the drive thin film transistor source target voltage and the actual voltage, i.e. the difference value ΔV of the node A and the actual voltage, to implement real-time detection to a threshold voltage deviation of the drive thin film transistor T2.

The second operational amplifier Y2 is electrically coupled to the latch and buffer circuit 21 and the pixel unit 1, and a positive input end thereof receives the data signal data, and a negative input end is grounded through a first switch S1 and then coupled to the output end of the first operational amplifier Y1, and an output end first outputs a data signal (data) voltage, and then outputs a sum of the data signal (data) voltage and the difference value ΔV of the drive thin film transistor source target voltage and the actual voltage outputted by the first operational amplifier Y1 to implement real-time compensation to the threshold voltage deviation of the drive thin film transistor T2.

As an illustration, the data signal data is inputted in the gate of the drive thin film transistor T2. If the actual threshold voltage of the drive thin film transistor T2 is 0.1V different from the ideal threshold voltage, accordingly, the difference value ΔV of the source target voltage of the drive thin film transistor T2 and the actual voltage of the drive thin film transistor T2 is 0.1V, i.e. the difference value ΔV of the node A and the actual voltage is 0.1V, too. The output end of the first operational amplifier outputs the 0.1V voltage difference value. Then, the second operational amplifier accumulates the 0.1V voltage difference value to the data signal (data) voltage. The source voltage of the drive thin film transistor T2, i.e. the voltage of the node A is correspondingly raised about 0.1V to compensate the threshold voltage deviation of the drive thin film transistor T2.

Considering of that the threshold voltage will become more stable after the organic light emitting diode D is used and ages for a period of time. Under circumstance that the threshold voltage deviation of the organic light emitting diode D does not needs to be compensated, the aforesaid AMOLED real-time compensation system already can realize the result of implementing real-time measurement, real-time compensation to each pixel unit, and the voltage value of the node A and the data signal data also have functional relation, no matter what the gray scale value of the data signal data is, there will be the corresponding A node voltage. Namely, the AMOLED real-time compensation system can effectively compensate all the gray scale data signals.

Figure 5:
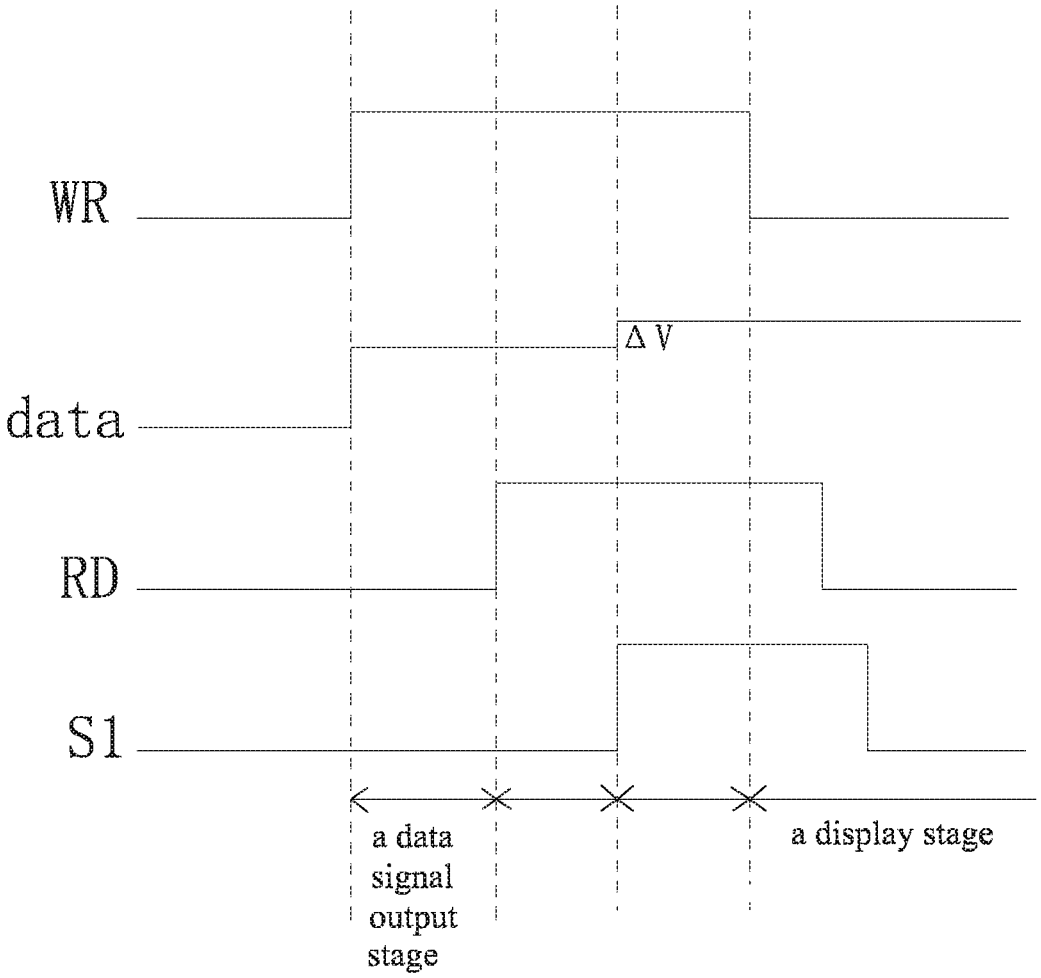
FIG. 5 is a time sequence diagram of the AMOLED real-time compensation system in a data signal output stage, a drive thin film transistor threshold voltage deviation real-time detection stage, a drive thin film transistor threshold voltage deviation real-time compensation stage and a display stage.

Furthermore, with combination of FIG. 3, FIG. 4 and FIG. 5, a work procedure of the AMOLED real-time compensation system comprises five stages in orders:

a data signal input stage: the control circuit 5 controls the data signal to be inputted into the source drive and real-time detection compensation integration circuit 2 to be latched in the latch and buffer circuit 21.

a data signal output stage: the gate drive signal WR is high voltage level, and the data signal (data) is high voltage level, and the detection start signal RD is low voltage level, and the first switch S1 is grounded under control of low voltage level, and the output end of the second operational amplifier Y2 outputs the data signal data, and the switch thin film transistor T1 is connected, and the drive thin film transistor T2 is connected; the drive thin film transistor source target voltage acquiring circuit 22 calculates and acquires a drive thin film transistor source target voltage according to the functional relation f(data) of the drive thin film transistor source target voltage and the data signal.

a drive thin film transistor threshold voltage deviation real-time detection stage: the detection start signal RD is high voltage level, and the detection thin film transistor T3 is connected, and the positive, negative input ends of the first operational amplifier Y1 respectively receive the drive thin film transistor source target voltage and the drive thin film transistor source actual voltage, and the output end outputs the difference value ΔV of the drive thin film transistor source target voltage and the actual voltage.

a drive thin film transistor threshold voltage deviation real-time compensation stage: the first switch S1 is coupled to the output end of the first operational amplifier Y1, and the positive input end of the second operational amplifier Y2 receives the data signal data, and the negative input end is coupled to the output end of the first operational amplifier Y1, and the output end outputs the sum of the data signal (data) voltage and the output end voltage of the first operational amplifier Y1.

a display stage: the gate drive signal WR and the detection start signal RD are changed to be low voltage level, and the switch thin film transistor T1 and the detection thin film transistor T3 are disconnected, and the organic light emitting diode D emits light for display.

For the AMOLED display device that the usage period is shorter, it is necessary to compensate the threshold voltage deviation of the organic light emitting diode. Therefore, the AMOLED real-time compensation system according to the present invention further comprises a storage circuit 6 electrically coupled to the control circuit 5, and the source drive and real-time detection compensation integration circuit 2 further comprises a current detector 23 electrically coupled to the control circuit 5. The current detector 23 is connected or disconnected with the detection line 12 through a second switch S2. The control circuit 5 calculates the threshold voltage deviation of the organic light emitting diode D according to a current value detected by the current detector 23, and the storage circuit 6 is employed to store the threshold voltage deviation of the organic light emitting diode D.

Corresponding, the work procedure of the AMOLED real-time compensation system needs to add an organic light emitting diode threshold voltage deviation detection stage before the data signal input stage: the gate drive signal WR is high voltage level, and the data signal data is low voltage level, and the detection start signal RD is high voltage level, and the first switch S1 is grounded, and the second switch S2 is closed, and the drive thin film transistor T2 is disconnected, and the detection thin film transistor T3 is connected, and the current detector 23 is connected with the detection line 12 through the second switch S2, and the current detector 23 discharges the organic light emitting diode D through the detection line 12, and the current detector 23 transmits a measured current value to the control circuit 5, and the control circuit 5 calculates a threshold voltage deviation of the organic light emitting diode D, and stores in the storage circuit 6.

In the next data signal input stage: the control circuit 5 first compensates the data signal with the threshold voltage deviation of the organic light emitting diode D, and then, inputs the compensated data signal into the source drive and real-time detection compensation integration circuit 2.

All the following data signal output stage, drive thin film transistor threshold voltage deviation real-time detection stage, drive thin film transistor threshold voltage deviation real-time compensation stage and display stage are implemented in orders. The description is not repeated here.

In conclusion, the present invention provides an AMOLED real-time compensation system, comprising a source drive and real-time detection compensation integration module, in which a first operational amplifier and a second operational amplifier are provided. The positive, negative input ends of the first operational amplifier respectively receive the drive thin film transistor source target voltage and the drive thin film transistor source actual voltage, and the output end outputs the difference value of the drive thin film transistor source target voltage and the actual voltage to implement real-time detection to a threshold voltage deviation of the drive thin film transistor. Then, the second operational amplifier accumulates the voltage difference value of the drive thin film transistor source target voltage and the actual voltage outputted by the outputted end of the first operational amplifier to the data signal voltage to implement real-time compensation to the threshold voltage deviation of the drive thin film transistor. The real-time measurement, real-time compensation to each pixel unit can be realized and all the gray scale data signals can be effectively compensated.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An Active Matrix Organic Light Emitting Display (AMOLED) real time compensation method, applied to an AMOLED real-time compensation system, comprising a plurality of pixel units aligned in array, which each includes a switch thin film transistor, a drive thin film transistor, a detection thin film transistor and an organic light emitting diode, a source drive and real-time detection compensation integration circuit, which includes a latch and buffer circuit, a first operational amplifier and a second operational amplifier, wherein the latch and buffer circuit, having a latch and a buffer, receives, latches, buffers and outputs a data signal; the first operational amplifier is electrically coupled to the pixel unit, and positive, negative input ends of the first operational amplifier respectively receive a drive thin film transistor source target voltage and a drive thin film transistor source actual voltage, and an output end of the first operational amplifier outputs a difference value of the drive thin film transistor source target voltage and the actual voltage to implement real-time detection to a threshold voltage deviation of the drive thin film transistor; the second operational amplifier is electrically coupled to the latch and buffer circuit and the pixel unit, and a positive input end of the second operational amplifier receives the data signal, and a negative input end of the second operational amplifier is grounded through a first switch and then coupled to the output end of the first operational amplifier, and an output end first of the second operational amplifier outputs a data signal voltage and then outputs a sum of the data signal voltage and an output end voltage of the first operational amplifier to implement real-time compensation to the threshold voltage deviation of the drive thin film transistor, wherein a gate of the switch thin film transistor receives a gate drive signal, and a source is electrically coupled to the output end of the second operational amplifier through the data line; a gate of the drive thin film transistor is electrically coupled to a drain of the switch thin film transistor, and a drain is coupled to a constant high voltage level, and a source is coupled to a node; a gate of the detection thin film transistor receives a detection start signal, and a source is coupled to the node, and a drain is electrically coupled to the negative input end of the first operational amplifier through the detection line; an anode of the organic light emitting diode is electrically coupled to the node, and a cathode is grounded, wherein the method comprises five stages of:

a data signal input stage: the data signal is inputted into the source drive and real-time detection compensation integration circuit to be latched in the latch and buffer circuit;

a data signal output stage: as the gate drive signal is high voltage level, and the data signal is high voltage level, and the detection start signal is low voltage level, and the first switch is grounded, and then the output end of the second operational amplifier outputs the data signal, and the switch thin film transistor is activated by the gate drive signal provided to the gate of the switch thin film transistor, and the drive thin film transistor is activated by the data signal from the drain of the switch thin film transistor; a drive thin film transistor source target voltage is calculated and acquired;

a drive thin film transistor threshold voltage deviation real-time detection stage: the detection start signal is high voltage level, and the detection thin film transistor is activated by detection start signal provided to the gate of detection thin film transistor, and the positive, negative input ends of the first operational amplifier respectively receive the drive thin film transistor source target voltage and the drive thin film transistor source actual voltage, and the output end of the first operational amplifier outputs the difference value of the drive thin film transistor source target voltage and the actual voltage;

a drive thin film transistor threshold voltage deviation real-time compensation stage: the first switch is coupled to the output end of the first operational amplifier, and the positive input end of the second operational amplifier receives the data signal, and the negative input end is coupled to the output end of the first operational amplifier, and the output end outputs the sum of the data signal voltage and the output end voltage of the first operational amplifier;

a display stage: the gate drive signal and the detection start signal are changed to be low voltage level, and the switch thin film transistor and the detection thin film transistor are respectively deactivated by the gate drive signal provided to the gate of the switch thin film transistor and by the detection start signal provided to the gate of detection thin film transistor, and the organic light emitting diode emits light for display.

2. The AMOLED real-time compensation method according to claim 1, wherein the pixel unit further comprises a storage capacitor, and one end of the storage capacitor is electrically coupled to the gate of the drive thin film transistor, and the other end of the storage capacitor is electrically coupled to the node.

3. The AMOLED real-time compensation method according to claim 1, wherein the source drive and real-time detection compensation integration circuit further comprises a current detector connected with a detection line through a second switch.

4. The AMOLED real-time compensation method according to claim 3, further comprising a storage device employed to store the threshold voltage deviation of the organic light emitting diode.

5. The AMOLED real-time compensation method according to claim 4, further comprising an organic light emitting diode threshold voltage deviation detection stage before the data signal input stage: the gate drive signal is high voltage level, and the data signal is low voltage level, and the detection start signal is high voltage level, and the first switch is grounded, and the second switch is closed, and the drive thin film transistor is disconnected, and the detection thin film transistor is connected, and the current detector is connected with the detection line through the second switch, and the current detector discharges the organic light emitting diode through the detection line, and the current detector transmits a measured current value for calculating an organic light emitting diode threshold voltage deviation to be stored in the storage device;

in the next data signal input stage: the data signal with the organic light emitting diode threshold voltage deviation is compensated, and then the compensated data signal is inputted into the source drive and real-time detection compensation integration circuit.

6. The AMOLED real-time compensation method according to claim 1, wherein the first switch is grounded under control of low voltage level, and coupled to the output end of the first operational amplifier under control of high voltage level.

* * * * *